United States Patent [19]

Burton

[11] Patent Number: 4,984,717

[45] Date of Patent: Jan. 15, 1991

[54] REFILLABLE PRESSURIZED BEVERAGE CONTAINER

[76] Inventor: John W. Burton, #4 Woodland Dr., Pittsburgh, Pa. 15228

[21] Appl. No.: 280,697

[22] Filed: Dec. 6, 1988

[51] Int. Cl.[5] ..... B67D 5/06

[52] U.S. Cl. ..... 222/183; 222/402.25; 222/402.14; 222/464; 222/529; 251/149.6

[58] Field of Search ..... 222/183, 402.1, 402.14, 222/402.35, 394, 464, 527, 529; 239/456, 457; 251/149.6, 149.7

[56] References Cited

U.S. PATENT DOCUMENTS

| | | | |
|---|---|---|---|
| 954,320 | 4/1910 | Megget | 239/457 |
| 2,274,409 | 2/1942 | Harbison | 222/183 |
| 2,297,814 | 10/1942 | Taymans et al. | 222/183 |
| 2,519,737 | 8/1950 | Brassington et al. | 239/456 |
| 2,747,755 | 5/1956 | Pritchard | 141/383 X |
| 3,251,574 | 5/1966 | Hansen | 251/149.7 |
| 3,314,578 | 4/1967 | La Mura | 222/402.25 |
| 3,462,063 | 8/1969 | McGee | 229/14 |
| 3,476,295 | 11/1969 | Telfer | 222/183 |
| 3,550,649 | 12/1970 | Meshberg | 141/3 |
| 3,556,171 | 1/1971 | Gangwisch | 141/3 |
| 4,124,076 | 11/1978 | Howard | 222/394 |
| 4,531,656 | 7/1985 | Nitchmann | 222/131 |
| 4,623,075 | 11/1986 | Riley | 222/183 |
| 4,832,237 | 5/1989 | Hurford | 251/149.6 |
| 4,863,201 | 9/1989 | Carstens | 251/149.6 |

FOREIGN PATENT DOCUMENTS

| | | | |
|---|---|---|---|
| 2027897 | 11/1970 | Fed. Rep. of Germany | 251/149.6 |
| 1400128 | 4/1965 | France | 141/3 |
| 1446338 | 8/1976 | United Kingdom | 222/183 |

OTHER PUBLICATIONS

Container Products Catalog for Spartansburg Steel Products, cover page and pp. 2 thru 5.

Official Gazette of Mar. 13, 1984, p. 571.

*Primary Examiner*—H. Grant Skaggs

*Attorney, Agent, or Firm*—Buchanan Ingersoll

[57] ABSTRACT

A pressurized, refillable, reusable container is disclosed which is comprised of a top, a base and at least one wall attached between the top and base which together define an enclosed space. A valve is provided through the top of the container which valve has a single resealable passageway for filling, pressurizing and emptying the container and means for attachment of the valve to a discharge nozzle or discharge tube through which a liquid stream may be carried from the valve to a remote location and there discharged.

23 Claims, 3 Drawing Sheets

REFILLABLE PRESSURIZED BEVERAGE CONTAINER

Field of Invention

The present invention relates to pressurized containers for holding and dispensing beverages and other fluids under pressure.

Background of the Invention

A number of containers have been developed for holding and dispensing carbonated beverages and other liquids, pastes and powders under pressure. Perhaps the most common are carbonated beverage bottles and cans as well as aerosol spray cans. One problem with conventional carbonated beverage bottles and cans is that after the container is opened the pressurized gas escapes causing the beverage to go "flat". Consequently, any carbonated beverage will lose its carbonation if left to stand after the container has been opened. Some bottles are factory refillable. Other bottles and cans are disposable.

Aerosol cans have been used to dispense a variety of liquids, pastes and powders, but not beverages. These containers generally retain the pressurized gas charge until most, if not all, of the material has been dispensed. These cans or bottles are generally not refillable having a can and valve assembly designed for a single filling at the factory.

The costs of the container, particularly disposable containers, are added to the purchase price of the product. Additionally, the user normally pays a bottle deposit on refillable bottles. Many states also require deposits or fees be paid on disposable containers to discourage littering.

There are, of course, large, pressurized containers which have been used for soft drink dispensing machines. These containers have large removable caps or lids for filling rather than filling through a single pressure tight valve. Also, gas pressure in conventional carbonated beverage dispensing machine cans or bottles is supplied through a second can valve from an external source of carbon dioxide. One valve is used for filling the container and the second is used for dispensing the product.

Another type of pressurized container is in use for fire extinguishers. Like the beverage container above, refilling is done only by the factory or an authorized service organization and then only by dismantling the bottle or can to expose a large neck opening through which to fill. Lids, valves and other components must then be removed before filling and reassembled after the unit has been pressurized.

There is a need for a refillable bottle which can be used for pressurized fluids such as carbonated beverages and which will allow the beverage to hold its carbonation after some of the product has been removed from the bottle. There is a further need for a refillable, pressurized container for products which have been or could be packaged and sold in aerosol cans. This includes beverage products, household cleaning products, spray paints, cosmetics, personal care products, foods and chemicals. Indeed, such a container would be useful for all industrial, commercial and consumer products that can be packaged, transported, sold and used when contained in a pressurized container. There is a need for a pressurized bottle or can which is refillable at a retail outlet. Use of this type of bottle provides lower manufacturing and production costs, lower packaging costs, requires minimal store shelf space and offers savings resulting from bulk storage, handling, transport and retailing of the products held by the refillable, pressurized bottle or can.

There is also a need for a refillable bottle whose contents are under sufficient pressure so that when a tube is connected to the bottle, the contents of the bottle will be discharged through the tube to a remote location without injecting a propellant into the bottle.

There is also a need for a refillable, pressurized bottle or can which utilizes but a single valve (unlike two valve carbonated beverage and beverage syrup dispensing system cans) through which filling, pressurizing and dispensing of fluid contents can take place. This both reduces costs and makes possible automatic filling and refilling machines which can fill the bottle or can without disassembling and reassembling the unit.

Summary of the Invention

The present invention provides a refillable bottle or can having a single valve through which the bottle is filled, pressurized and emptied. This bottle, preferably is comprised of an inner shell made of blow molded plastic similar to the conventional two liter or three liter soft drink bottles now in the marketplace. There is also an outer shell of metal, hard plastic or other reinforcing material attached to the inner shell for reinforcement. The bottle or can may also be fabricated of aluminum, coated steel, stainless steel, or other material suitable to contain the fluid contents. The container has a single, push type, basket valve which an external probe may engage for filling and to which a nozzle or tube can be connected for emptying the bottle. The valve is provided with openings of sufficient size to permit rapid filling and discharge of the bottle. Preferably, the bottle should be able to be filled and pressurized in one minute or less. The contents of the bottle should be under sufficient pressure to force those contents through a dip tube and valve when this valve is open. Consequently, no propellant need be added to my refillable bottle after filling to discharge the contents. But, I prefer to pressurize the bottle with an external gas source to 60 p.s.i. Additionally, for some products, such as beer and wine, I prefer to draw a vacuum on the bottle; fill and then pressurize the bottle with an outside gas source. When the probe is engaged to the valve for emptying the bottle a range of appropriate fittings may be attached to the probe. Such fittings include spray nozzles, a diffuser-type nozzle to retain carbonation in the liquid dispensed, and open nozzles for foaming or discharging a liquid stream of the dispensed fluid. For filling the bottle, the probe is connected to an appropriate product supply system. Preferably this system includes means for excavating the bottle, filling it with product and charging the bottle with gas. Other objects and advantages will become apparent as a present description of the preferred embodiment of the invention proceeds.

Description of the Preferred Embodiments

Figure 1:
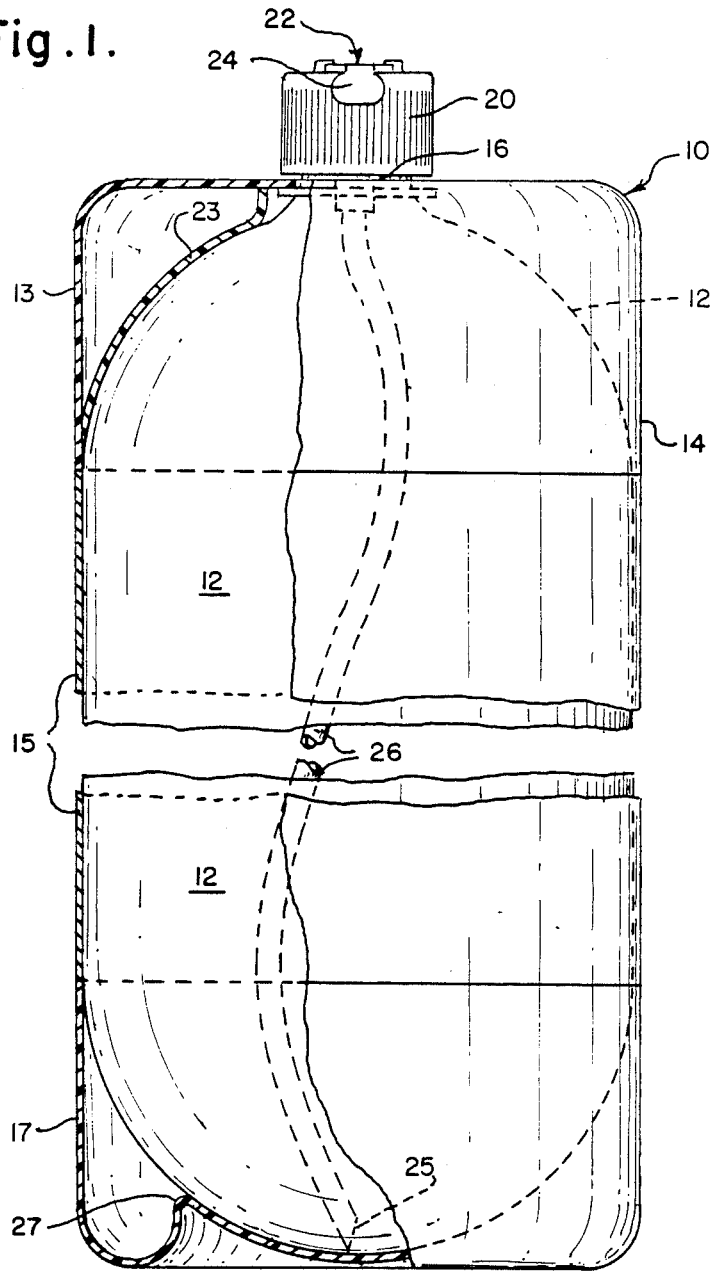
FIG. 1 is a side view, partially in section, of the present preferred reinforced blow molded plastic embodiment of my container.

Referring to FIG. 1, I provide a bottle 10, preferably having an inner shell 12, which is blow molded from plastic in the conventional manner. The shell 12 could also be made from non-corrosive materials such as aluminum, stainless steel or other material which meets FDA standards for food and beverage containers. Alternatively, the entire container could also be fabricated from such materials. Attached to the inner shell is an outer shell 14 which I prefer to make in three pieces. First there is a reinforcing wrap 15 made of a strong plastic or metal, such as stainless steel or aluminum, which is wrapped about the center of the inner shell 12. This reinforcement is applied by cementing the layer to the inner shell. Alternatively, it may be placed in a blow mold when the inner shell is made and attached during molding. I also provide an upper end portion 13 of the outer shell which is attached to the upper portion of the inner shell 12 by cementing or during molding. Finally, there is a lower portion of the outer shell 17 which is similarly made of metal or hard plastic to provide reinforcement. This too can be cemented to the inner shell 12 or made a portion of the inner shell during molding. Because the bottle is designed to withstand both vacuum or negative pressure as well as above atmospheric pressures, I may design the top portion 13 so that it has an inner surface 23 which conforms and attaches to the inner shell 12 as shown in FIG. 1. Similarly, an inner surface 27 is provided on the bottom portion 17 and is attached to inner shell 12 by cementing or during molding. The inner surface 27 of the bottom portion conforms to and covers a substantial part of the bottom of the inner shell. I prefer to provide a conventional mouth 16 having outer threads 18 for receipt of a cap 20. Within the cap I provide a valve 22 having an optional outer lock 24. A sealing ring (not shown) may be placed in the cap to engage and seal the mouth of the bottle. The use of a removable screw cap 20 permits easy cleaning and sterilization of the bottle and capdipstick assembly. However, one could easily mold cap 20 to the mouth of the inner shell if desired. Finally, I provide a flexible dip tube 26 which extends from valve 22. The contents of the bottle should be under sufficient pressure to force those contents through the dip tube and valve 22 when the valve is open. Consequently, no propellant need be added to my refillable bottle after filling to discharge the contents. I prefer to terminate the dip tube at an angle 25. Also, tube 26 does not quite reach the bottom of the inner shell so that when the bottle is tipped on its side it will lay against the side. Consequently, I am able to dispense all of the contents of my container when it is either in the vertical position, in an inverted position or in a horizontal position. The dip tube 26 should be made of a flexible material such as rubber or plastic.

Figure 2:
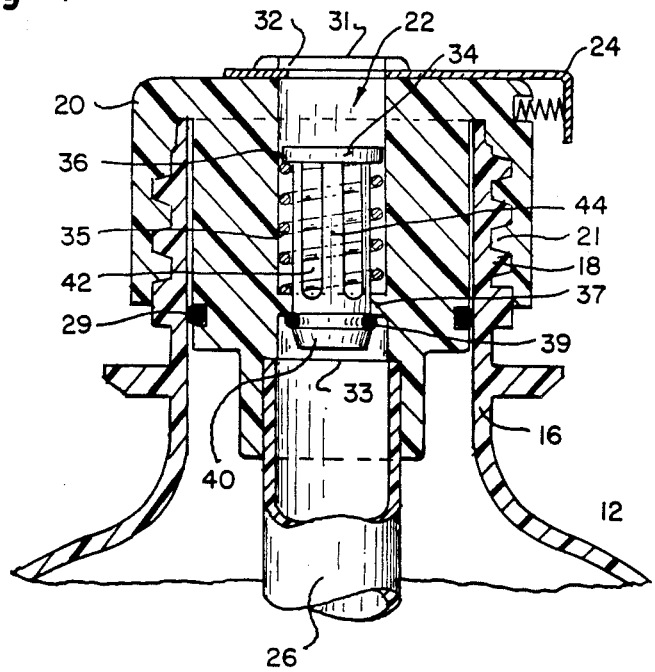
FIG. 2 is a sectional view of the cap and valve portion of the embodiment of FIG. 1.

In FIG. 2, I have shown a present preferred embodiment of the cap and valve arrangement. The cap 20, which can be made of metal or plastic, is preferably molded of plastic to have inner threads 21 which mate with threads 18 on the mouth of the bottle. I also prefer to provide an 0-ring seal 29 which seals any gap between the cap and the mouth of the bottle. Within the cap there is a valve 22. This valve consists of a generally cylindrical outer housing 32 with openings 31 and 33. Within housing 32 is a basket 34 which rests on springs 35. This spring is positioned between upper rim 36 of basket 34 and shoulder 37. The basket is closed at its bottom 40, but has a plurality of slots 42 in the side wall 44. Preferably the slots are sized to provide a combined open area of about 0.25 square inches which allows me to fill and pressurize a two liter container to 60 p.s.i. in less than 30 seconds. That container can fill twelve ounce cups in about ten seconds. Furthermore, the valve allows me to dispense liquid contents of my bottle in a continuous liquid stream rather than a foam or spray. The valve is operated by inserting a probe 50. When the probe is removed the basket returns to its original position shown in FIG. 2. This allows me to dispense a portion of a carbonated beverage from my bottle without destroying or adversely affecting the carbonation of the contents which remain in the bottle. An exterior seal 39 is provided on the lower portion of the basket 34. Dip tube 26 is attached to the cap in any conventional manner such as providing a force fit as shown in FIG. 2. If bottles are being used for several different types of fluids one may make the cap 20, the valve 22 or both in different sizes. Only one size is used for a given fluid to prevent or discourage the user from filling a bottle with an incorrect or inappropriate fluid. Otherwise, my bottle can be filled and refilled with any liquid and any gas chosen by the user. One may also incorporate a pressure relief valve in the cap.

Figure 3:
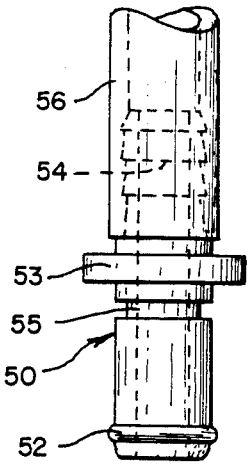
FIG. 3 is a side view of one type of probe which can be inserted into the valve portion of the bottle for filling or dispensing a product.

Turning to FIG. 3 connector fitting 50 is a generally cylindrical tube having an O-ring seal 52 about its lower end. This end is inserted into valve 22 and pushes valve basket 34 (FIG. 2) opening the valve. Seal 52 mates with the inner surface of the valve to prevent liquid from flowing around the outside of the probe. A shoulder 53 is provided on the probe for ease of inserting and removing the probe from the valve. Slot 55 can be engaged by a lock means 24 on the cap (see FIG. 2). A remote tube 56 can be fitted over the opposite end 54 of the probe. This tube can be used for dispensing product from the bottle or filling the bottle. The tube may be attached to the probe in any conventional manner and may be flexible or rigid. I have found that the use of any inert gas at pressures between 15 p.s.i. and 60 p.s.i. will cause the liquid to be fully dispensed from the bottle. No constricting or measuring devices are required or suggested for my container. Rather, I prefer to have a single valve which allows unrestricted flow to the atmosphere. I have also found that the provision of a concave inner surface on the inner shell will permit the bottle to be used as a carbonator for making carbonated beverages. This is done by filling the bottle up to ⅔ full with a liquid, preferably at a temperature near its freezing point, and then filling the remaining portion of the bottle with carbon dioxide to a pressure between 15 p.s.i. and 60 p.s.i. Next one shakes the container which causes the carbon dioxide to be dispersed throughout the liquid. The amount of carbonation will depend upon the temperature or the liquid, the degree of agitation as well as the diffuser used to dispense the liquid. To obtain higher carbonation one may add more gas and shake the container again.

Figure 4:
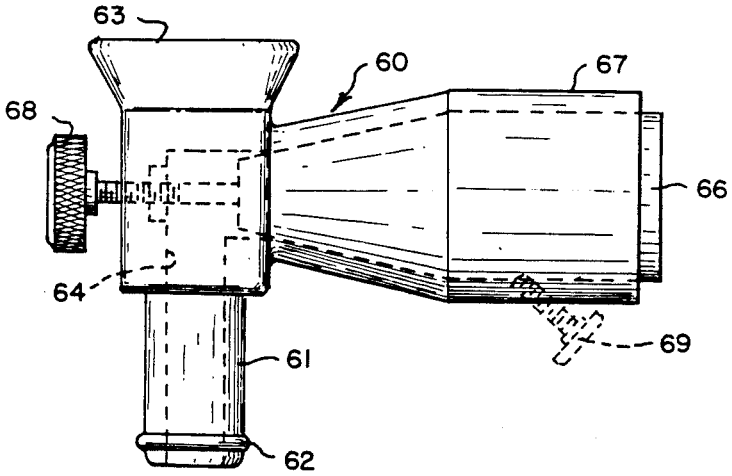
FIG. 4 is a portable diffuser nozzle useful for dispensing carbonated beverages which can be inserted into the valve portion of the bottle or connected through a remote connector valve and tubing to a connected fitting inserted into the valve portion of the bottle.

In FIG. 4 I show a diffuser valve which can be inserted directly or indirectly into valve 22 of the bottle. An indirect connection can be made by inserting a probe with attached flexible tube, such as is shown in FIG. 3, into valve 22. A second valve similar to valve 22 is connected to the distal end of the tube and the diffuser valve is inserted into the remote valve. This diffuser valve 60 has a cylindrical probe-type end 61 with an O-ring seal 62. That end is inserted into valve 22 of the bottle in the same manner as the probe shown in FIG. 3. Fluid then flows from the bottle through valve 22, passageway 64 and nozzle 67. A land 63 on the nozzle allows one to easily push the nozzle into valve 22. A diffuser cone 66 is provided within the nozzle 67 of the diffuser valve. This nozzle cone is moveable relative to the nozzle. Movement is controlled by a hand screw 68 attached to the end of the cone. A seal 65 is provided where the screw enters the nozzle. Alternatively, one could use a screw 69 shown in chain line which passes through the nozzle and connects to the diffuser cone. The screw enables one to control the amount of carbonation in the liquid being dispensed by regulating the clearance or size of opening through which a liquid may flow.

Although the present bottle is particularly useful for carbonated beverages it can be used for any fluid including, but not limited to, fine powders, paints and other coatings, liquid foods, cooking liquids, perfumes, creams, liquid soaps, cosmetics, personal care products, liquid waxes, insecticides, fertilizers, glue, mastics, lubricants, beer, wine, wine coolers, juices and carbonated juices. I have found that this bottle is particularly useful for storing and serving all types of carbonated beverages, soft drinks, beer, wine, wine coolers, carbonated and uncarbonated juices and juice drinks. Prior to the present invention the art had not found a dispenser for carbonated beverages which would retain carbonation in the beverage after the container was opened and some beverage had been removed from the container.

Figure 5:
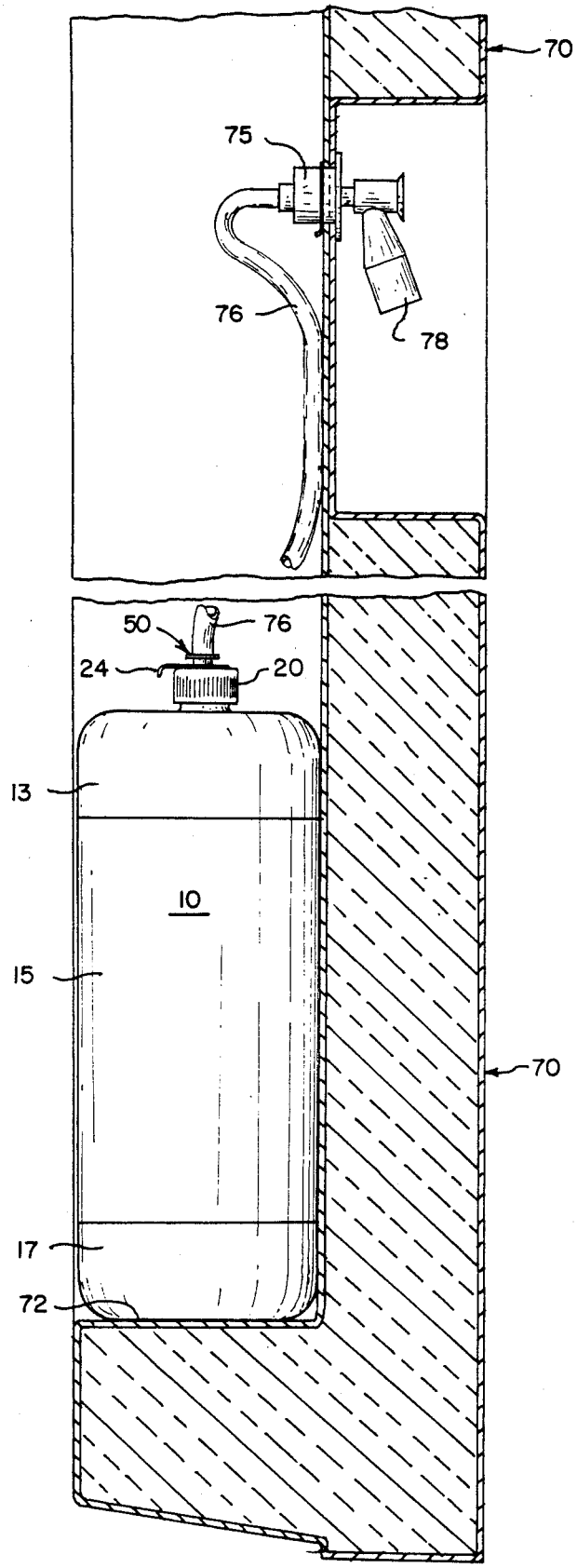
FIG. 5 is an elevational view of the bottle of FIG. 1 placed in a refrigerator door or on a refrigerator shelf and having a hose and remote diffuser attached to the bottle through the door or the side of the refrigerator.

My bottle can be stored vertically or horizontally in a variety of containers including refrigerators, beer and soft drink dispensers, ice chests, cabinets and home bars. In these instances one may provide a delivery tube between the bottle valve 22 and dispensing nozzle. This will permit product to be removed from the bottle without handling the bottle or opening the refrigerator or other container. In FIG. 5 I show my bottle 10 placed on a shelf 72 horizontally or vertically in a refrigerator or a refrigerator door. A delivery tube 76 extends from a probe 50 which has been inserted into the valve in cap 20 and is locked in place by lock 24. The probe engages and opens valve 22 in bottle 10 which charges tube 76. Tube 76 has a connector 75 which extends through the refrigerator door or side of the refrigerator 70. Preferably, this connector has a valve in it to prevent liquid from flowing through it if nozzle 78 is not in place. This valve could be similar to that used in my bottle cap which is shown in FIG. 2. Finally, a diffuser nozzle 78 is attached to connector 75. To remove product from bottle 10 one simply opens nozzle 78 by depressing the diffuser 78 into spring loaded valve 75. This can be done without opening the refrigerator door. There is sufficient self contained gas pressure within the bottle to propel all of the fluid from the bottle. Preferably, that pressure will be high enough to further propel the liquid through the tube 76 and nozzle 78. When the bottle 10 is empty one simply disconnects probe 50, replaces the empty bottle with a full bottle and inserts probe 50 into the full bottle. Although I have shown my bottle in a refrigerator one could place the bottle in a shelf in any cabinet. Furthermore, several of my pressurized containers could be collectively attached to tube 76 thereby greatly increasing the amount of fluids that may be dispensed through valve 75 and diffuser 78 without refilling or replacing a bottle. To increase the variety of fluid dispensed one can use several arrangements similar to that shown in FIG. 5. One may also add a check valve to probe 50 which would enable the user to remove the probe 50 before the bottle is discharged and insert it into another bottle.

My bottle can be used for soaps, laundry detergent, fabric softener or any other industrial, commercial or household fluid. In those instances the bottle could be built into a washing machine, clothes dryer, dishwasher, floor scrubber or other appliance. Means could then be provided so that the cleaning agent is dispensed at the appropriate times in the machine cycle. Indeed, my bottle could be used with any device in which a fluid is dispensed during the operation of the appliance or machine. Furthermore, one can use a combination of both soluble liquids and gases as well as nonsoluble liquids and gases.

While I have shown several present preferred embodiments of the invention, it is to be distinctly understood that the invention is not limited thereto, but may be variously embodied within the scope of the following claims.

I claim:

1. A refillable, reusable container suitable for automatic filling and pressurization, capable of discharging a liquid stream at the container and able to be connected to a discharge tube through which a liquid stream may be carried to a remote location and there discharged comprised of a top having an opening, a base and at least one wall attached between the top and the base which together define an enclosed space, a removable, reusable, resealable cap connected to the top, covering the opening and sealing the container and at least one spring loaded valve attached to said cap, said valve having a basket portion comprised of a substantially open top, a bottom and side supports between the top and the bottom with passageways therebetween for filling the container with a liquid stream, pressurizing and emptying the container in a liquid stream containing all liquids contents or any portion of said contents of the container, said container being sized and constructed so as to be capable of retaining fluid at pressures above atmospheric pressure, said valve being capable of being opened by one of a tubular filler probe and a discharge nozzle having a tubular probe which engages and opens the valve when the probe moves and pushes toward the enclosed space and said valve being closed when the valve is not pushed toward the enclosed space and when open said valve has passageways sized and positioned to permit a liquid to easily flow through said valve at substantially the same volume per second flow rate as a rate at which the liquid may flow through the probe.

2. The container of claim 1 wherein the top, base, at least one wall and cap are composed of a noncorrosive material.

3. The container of claim 2 wherein the noncorrosive material is one of plastic, stainless steel and aluminum.

4. The container of claim 2 wherein the noncorrosive material is an FDA approved material for use with food and beverages.

5. The container of claim 1 wherein the walls, top and base are made from one of plastic and metal also comprising a reinforcing wrap attached to the container wall, said wrap being sized and positioned to provided increased strength to the container.

6. The refillable container of claim 1 also comprising a discharge tube one end of which is connected to the valve and a diffuser connected to an opposite end of the discharge tube.

7. The refillable container of claim 1 wherein the valve is provided with openings of sufficient size to allow as much as 12 liters of liquid to flow through the valve in not more than 60 seconds when the bottle contains a gas at 60 p.s.i. before the valve is opened and liquid flow begins.

8. The refillable container of claim 1 wherein the valve is provided with openings of sufficient size to allow as much as 12 ounces of liquid to flow through the valve in a continuous, nonfoaming liquid stream and in not more than 15 seconds when the bottle contains a gas at 60 p.s.i. before the valve is opened and liquid flow begins.

9. The container of claim 1 also comprising a fluid within the enclosed space and filling approximately two thirds of the enclosed space and a gas within the enclosed space.

10. The container of claim 9 wherein the gas is at a pressure above atmospheric pressure.

11. The container of claim 10 wherein the gas is at a pressure between 15 p.s.i. and 60 p.s.i..

12. The container of claim 1 wherein the valve is spring loaded and can be opened by pushing a probe through the passageway.

13. The container of claim 1 wherein at least one of the top and the base is sized to provide a concave surface adjacent to the enclosed space which concave surface will permit a fluid and gas within the enclosed space to mix under pressure when the container is shaken and dispense gas bubbles within the fluid.

14. The container of claim 1 also comprising a tube attached to the valve at its passageway and extending into the enclosed space so that contents of the container are discharged through the tube.

15. The container of claim 14 wherein the tube is flexible and extends to the base of the container thereby allowing the container to be emptied when the container is in a vertical position, in an inverted position and in a horizontal position.

16. The container of claim 1 also comprising a nozzle attached to the valve.

17. The container of claim 16 wherein the nozzle is one of a diffuser nozzle, a spray nozzle and a foam nozzle.

18. The container of claim 1 sized and constructed to accommodate and withstand a vacuum within the enclosed space.

19. The container of claim 1 wherein the valve and container are sized and configured to allow the container to be filled automatically by a filling machine.

20. The container of claim 1 wherein the cap, top, base and said at least one wall sized and constructed of a material to allow the cap to be removed, all components of the container sterilized to FDA specifications and the cap replaced thereby providing a reusable, sterilized container.

21. The container of claim 1 also comprising a seal between the cap and the top.

22. The container of claim 1 also comprising a liquid and a gas above atmospheric pressure in the enclosed space which has entered the enclosed space through the valve.

23. A refillable container suitable for automatic filling and pressurization, capable of discharging a liquid stream at the container and able to be connected to a discharge tube through which a liquid stream may be carried to a remote location and there discharged comprised of a top, a base and at least one wall attached between the top and the base which together define an enclosed space, a removable cap attached to said top at an opening of the top and at least one spring loaded valve attached to said cap having a single resealable passageway for filling, pressurizing and emptying the container, said container being sized and constructed so as to be capable of retaining fluid at pressures above atmospheric pressure, said valve being capable of being opened by one of a tubular filler probe and a discharge nozzle having a tubular probe which engages and opens the valve when the probe moves and pushes toward the enclosed space and said valve being closed when the valve is not pushed toward the enclosed space and when open said valve has passageways on a movable valve closure, the passageways sized and positioned to permit a liquid to easily flow through said valve at substantially the same volume per second flow rate as a rate at which the liquid may flow through the probe and said valve having lock means for attachment of the valve to one of a discharge nozzle and a discharge tube through which a liquid stream may be carried from the valve to a remote location and there discharged.

* * * * *